US005322271A

United States Patent [19]

Ganter

[11] Patent Number: 5,322,271

[45] Date of Patent: Jun. 21, 1994

[54] DEVICE FOR STACKING SHEETS IN A PILE

[75] Inventor: Udo Ganter, Herschberg-Leutershausen, Fed. Rep. of Germany

[73] Assignee: Heidelberger Druckmaschinen AG, Heidelberg, Fed. Rep. of Germany

[21] Appl. No.: 986,859

[22] Filed: Dec. 4, 1992

[30] Foreign Application Priority Data

Dec. 4, 1991 [DE] Fed. Rep. of Germany ..... 4139978

[51] Int. Cl.[5] ..... B65H 31/04

[52] U.S. Cl. ..... 271/214; 198/836.1; 271/213

[58] Field of Search ..... 271/236, 238, 248, 253, 271/157, 171, 213, 214, 215, 217; 198/836.1

[56] References Cited

U.S. PATENT DOCUMENTS

| | | | |
|---|---|---|---|
| 2,626,801 | 1/1953 | Uriell | 271/89 |
| 4,452,351 | 6/1984 | Meeker | 271/236 X |
| 4,513,858 | 4/1985 | Fellner et al. | 198/836.1 |
| 4,585,225 | 4/1986 | Miura | 271/215 X |
| 5,121,169 | 6/1992 | Kawabata | 271/171 X |
| 5,172,903 | 12/1992 | Haneda et al. | 271/171 |

FOREIGN PATENT DOCUMENTS

| | | | |
|---|---|---|---|
| 3601294 | 7/1987 | Fed. Rep. of Germany . | |
| 2286557 | 11/1990 | Japan . | |
| 958282 | 9/1982 | U.S.S.R. | 271/236 |

*Primary Examiner*—H. Grant Skaggs
*Assistant Examiner*—Carol Lynn Druzbick
*Attorney, Agent, or Firm*—Herbert L. Lerner; Laurence A. Greenberg

[57] ABSTRACT

A device for stacking sheets in a pile in a sheet delivery of a printing press having a conveying mechanism for transporting sheets in a given direction onto the pile, and a lifting table whereon the sheets are lowerable, includes a front stop for leading edges of the sheets disposed in a region wherein an upper end of the sheet pile is located, side stops disposed laterally of the front stop and adjustable to varying formats of the sheets, each of the stops having a multiplicity of sections successively arranged in the given sheet transport direction and being movable relative to one another, those of the sections exceeding a successive arrangement of the sections which matches the format length of the sheets in the sheet pile being displaceable into a waiting position wherein they avoid any obstruction to the transport of the sheets onto the pile, and respective multipartite guides for the sections of the side stops each of the multipartite guides being formed of two parts telescopically slidable into one another in the given sheet transport direction, at least those sections which are effective only when the respective sheet format exceeds a minimum format being movable in the given sheet transport direction and displaceable into the waiting position.

9 Claims, 4 Drawing Sheets

DEVICE FOR STACKING SHEETS IN A PILE

The invention relates to a device for stacking sheets in a pile which is, more particularly, in a sheet delivery of a printing press having conveying means for transporting sheets in a given direction onto the pile, and a lifting table whereon the sheets are lowerable.

German Published, Non-Examined Patent Application (DE-OS) 36 01 294 describes side stops for sheets which are transported between transport tapes to a position above a pile location on an automatically lowerable lifting table, so that the upper end of the pile is always approximately at the same height. In this heretofore known arrangement, sections of the side stops are formed of metal strips arranged adjacent one another in the transport direction of the sheet. The metal strips are disposed on carriers so as to be adjustable in height between a lower end position, in which they form a stop for the sides of the sheets, and an upper end position, in which they assume a waiting position in which they avoid obstructing the adjustment of the device to smaller sheet formats. The carriers extend parallel to the sides of the sheets and, in this regard, are adjustable in transverse direction for matching different sheet formats and are of a length adapted to the maximum sheet format. This permits the length of the mutually adjacent sections forming the side stop for the sheet to be adjusted or matched to the side length of the respective sheet format and for the remaining sections to be raised into a waiting position so that they do not obstruct the operation of the transport means in the case of smaller sheet formats. From this German publication, it has also become known to provide the sections with necessary means for cooperating with format-adjusting elements so that those sections which are not required for forming the side stops are automatically raised into the waiting position whenever there is a change of sheet format.

It is accordingly an object of the invention to provide a device of the foregoing general type which, whenever there is a change of sheet format, adjusts over the entire length thereof to the length of the set sheet format, so that particularly in the case of smaller sheet formats, more space is created for other elements of the sheet-piling device.

With the foregoing and other objects in view, there is provided, in accordance with the invention, a device for stacking sheets in a pile in a sheet delivery of a printing press having conveying means for transporting sheets in a given direction onto the pile, and a lifting table whereon the sheets are lowerable, the device comprising a front stop for leading edges of the sheets disposed in a region wherein an upper end of the sheet pile is located, side stops disposed laterally of the front stop and adjustable to varying formats of the sheets, each of the stops comprising a multiplicity of sections successively arranged in the given sheet transport direction and being movable relative to one another, those of the sections exceeding a successive arrangement of the sections which matches the format length of the sheets in the sheet pile being displaceable into a waiting position wherein they avoid any obstruction to the transport of the sheets onto the pile, and respective multipartite guides for the sections of the side stops, each of the multipartite guides being formed of two parts telescopically slidable into one another in the given sheet transport direction, at least those sections which are effective only when the respective sheet format exceeds a minimum format being movable in the given sheet transport direction and displaceable into the waiting position.

The telescopically retractable and extensible guide affords the advantage that it always extends only over the length of the respectively set format of a sheet and thus has no parts which continuously extend over the length of a maximum sheet format.

A further important advantage is that the guide provides a waiting position for the non-required sections, which are disposed laterally to those sections which act as a side stop for the respectively set sheet format. This permits the device according to the invention to be of a relatively small overall height.

In accordance with another feature of the invention, each of the guides comprises a housing formed of the two parts, one of the parts being laterally adjustable within a range conforming to a minimum sheet format and being formed with a telescopic mounting for at least the other of the parts.

Thus, the guide for the sections may be disposed and accommodated in a housing formed of telescoping parts. One of the housing parts may be firmly or fixedly connected to conventional elements for affecting a side adjustment, so that at least another housing part may be slidable telescopically in and out of the fixed housing part. In the movable housing part, the guide for the sections affects a transition, via a deflection or reversal of direction, into a part associated with the waiting position. In the case of smaller sheet formats, those sections which are not required for the side stop which matches the format length of the sheet are displaced into a waiting position to the side of those sections which act as the paper stop and conform with the format length.

In accordance with a further feature of the invention, the sections of each side stop form a continuous band extending in the given sheet transport direction and ar held at respective ends thereof in the respective guide, the guide being formed with a direction-deflecting location in one of the telescoping parts.

In accordance with further details of the invention, the sections of each of the side stops form parts of a flexible grid band; and the flexible grid band is formed of plastic material.

In a preferred construction, the sections thus form parts of a flexible band, the two ends of the sections, at top and bottom thereof, each engaging in guide tracks or guide slots of the telescopically extensible and retractable housing. The sections may accordingly be formed on a plastic band of relatively small wall thickness between the sections, thereby providing a high degree of flexibility. The sections are formed by raised protrusions from the band and, when they are acting as the side stop, project beyond the side surface of the housing facing towards the sheet.

In accordance with an added feature of the invention, one of the housing parts is displaceable and is connected to parts which are adjustable for format changes.

Thus, the movable housing part may be connected in relatively simple manner to format-adjusting elements, so that, whenever there is a change of sheet format, the device adjusts automatically to the new format setting.

In accordance with an additional feature of the invention, the housing is formed with a union for connecting an air extractor thereto. By connecting the housing to an air extractor, assurance is provided that the usual air cushion which forms in the upper part of the sheet pile, particularly under the uppermost incoming sheet, is reduced considerably, so that there is a better deposition of the sheets, a better pile formation and a greater speed at which the sheets descend or sink.

In accordance with yet another feature of the invention, there are provided linear bearing rails with rolling bodies disposed between the parts of the housing.

In accordance with a concomitant feature of the invention, the housing includes a lower and an upper guide track wherein the ends of the sections of the side stop engage, the lower and the upper guide track being formed with a parking loop in one of the parts of the housing.

Other features which are considered as characteristic for the invention are set forth in the appended claims. Although the invention is illustrated and described herein as embodied in a device for stacking sheets in a pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
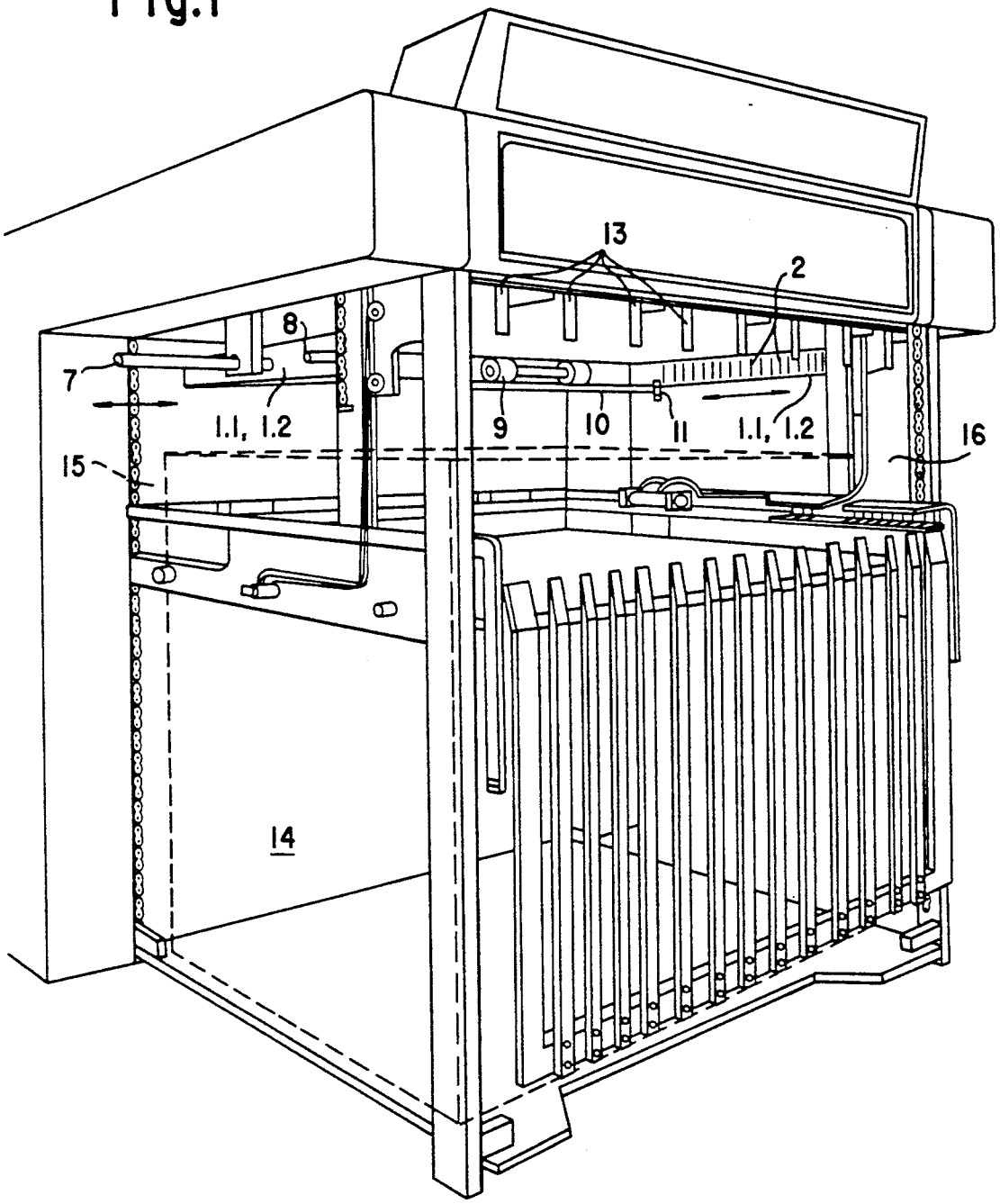
FIG. 1 is a diagrammatic front and side perspective view of a sheet delivery of a printing press incorporating the device according to the invention.

A side stop of the type relevant to the invention is part of a sheet-piling device of the type used, for example, in the sheet delivery of a printing press, as shown in FIG. 1.

Reference is made now in greater detail to the drawings FIGS. 1 to 4 which illustrate an embodiment of a side stop according to the invention, having mutually adjacent, vertically extending sections 2 disposed facing a sheet pile 14, shown in phantom lines, in an open side of a multipartite housing formed of a fixed part 1.1 and a movable part 1.2. The limiting or defining surfaces of the sections 2 face the sheet pile 14 having leading edges 16 and trailing edges 15, and form the side stop per se. FIG. 1 also shows eight rectangular, downward-pointing front stops 13. Upper and lower sides sections 2 engage in a guide 3 formed in the two housing parts 1.1 and 1.2. In the illustrated embodiment, the sections are movably interconnected at longitudinal edges thereof. The sections 2 are incorporated with the surface which forms the side of the stop in a flush manner, into the side surfaces of the housing 1.1 and 1.2. In the movable housing part 1.2, the guide 3 effects a transition, via a direction-reversal or deflection location 4, into a guide part 5 extending at least within the movable housing part 1.2. The mutually adjacent sections 2 are arranged over a length matched to the length of a maximum format of a sheet which can be processed in the sheet pile or stacking device. The maximum length of the telescopic housing parts 1.1 and 1.2 is also matched to the maximum format length. In order to reduce the frictional forces which occur during axial displacement, linear bearing rails 6 (FIG. 4) with rolling bodies of commercially available construction are disposed between the housing parts 1.1 and 1.2 on the rear side of the housing opposite the sections 2. The fixed housing part 1.1 is connected adjustably, by means of a linkage or rod 7, to the frame of the pile or stacking device. The housing part 1.1 serves the purpose of effecting a format adjustment transversely to the sheet-transport direction. A union fitting 8 permits the housing interior to be connected to an air extractor.

Figure 2:
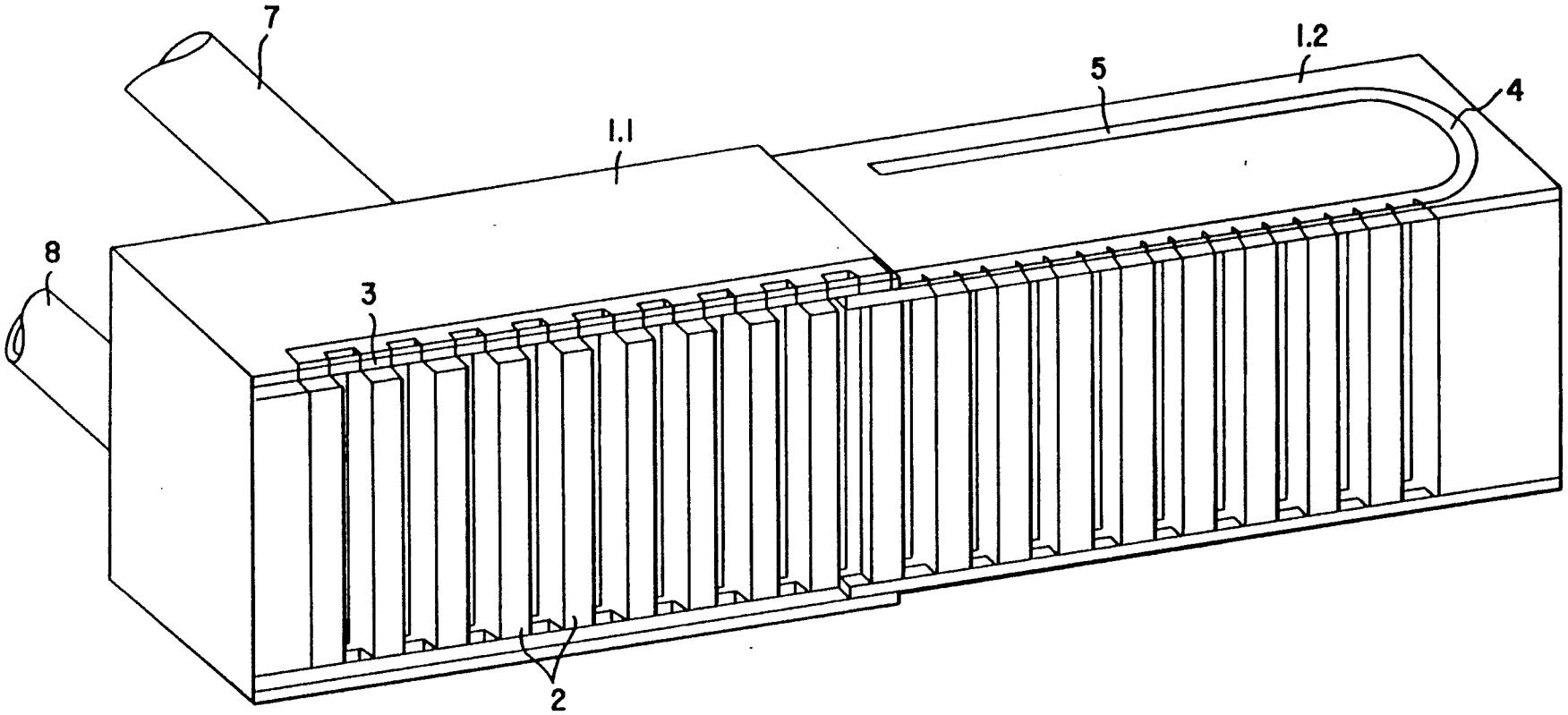
FIG. 2 is a top front and side perspective view of a side stop constructed in accordance with the invention.
Figure 3:
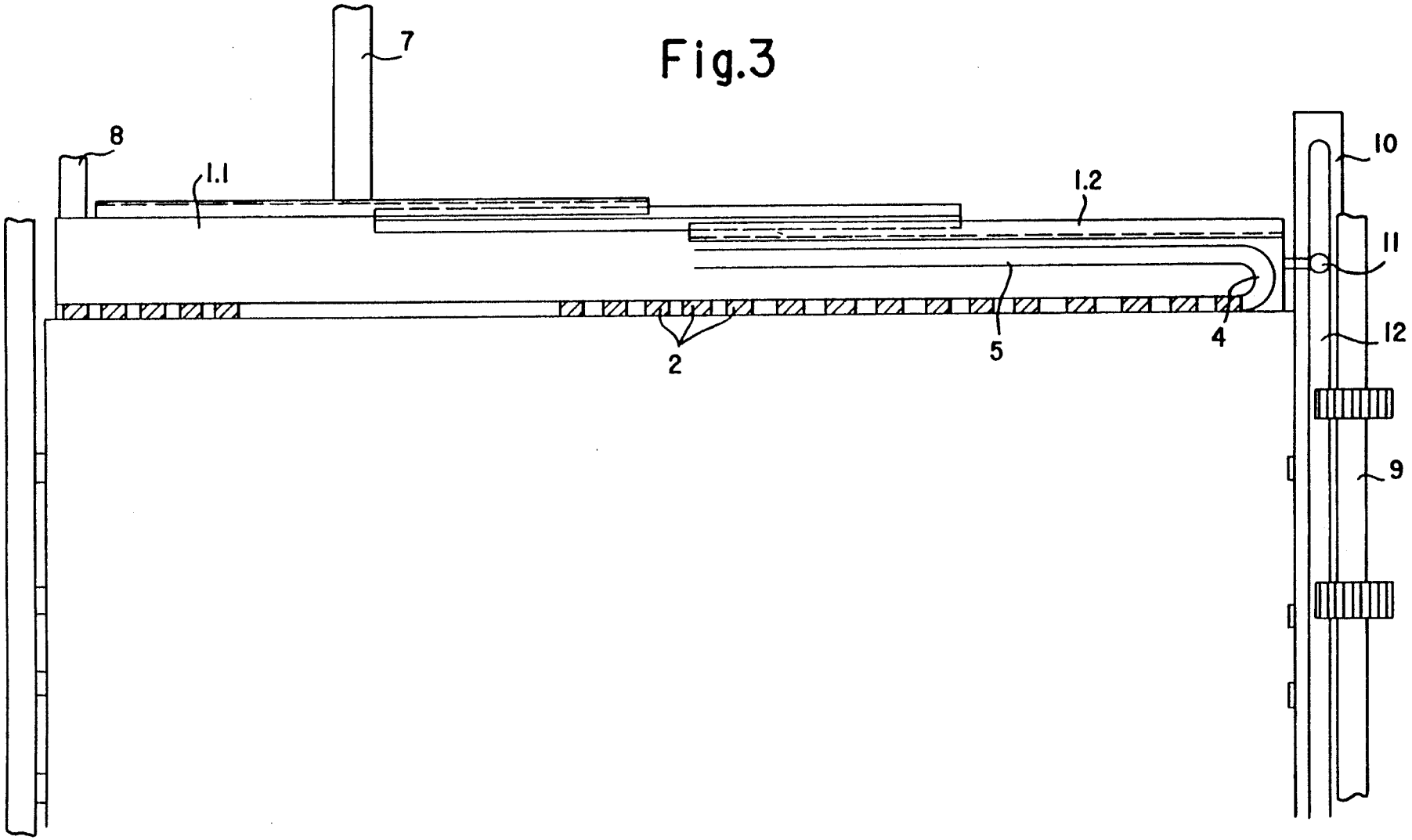
FIG. 3 is a diagrammatic plan view, partly sectional, of a side stop.
Figure 4:
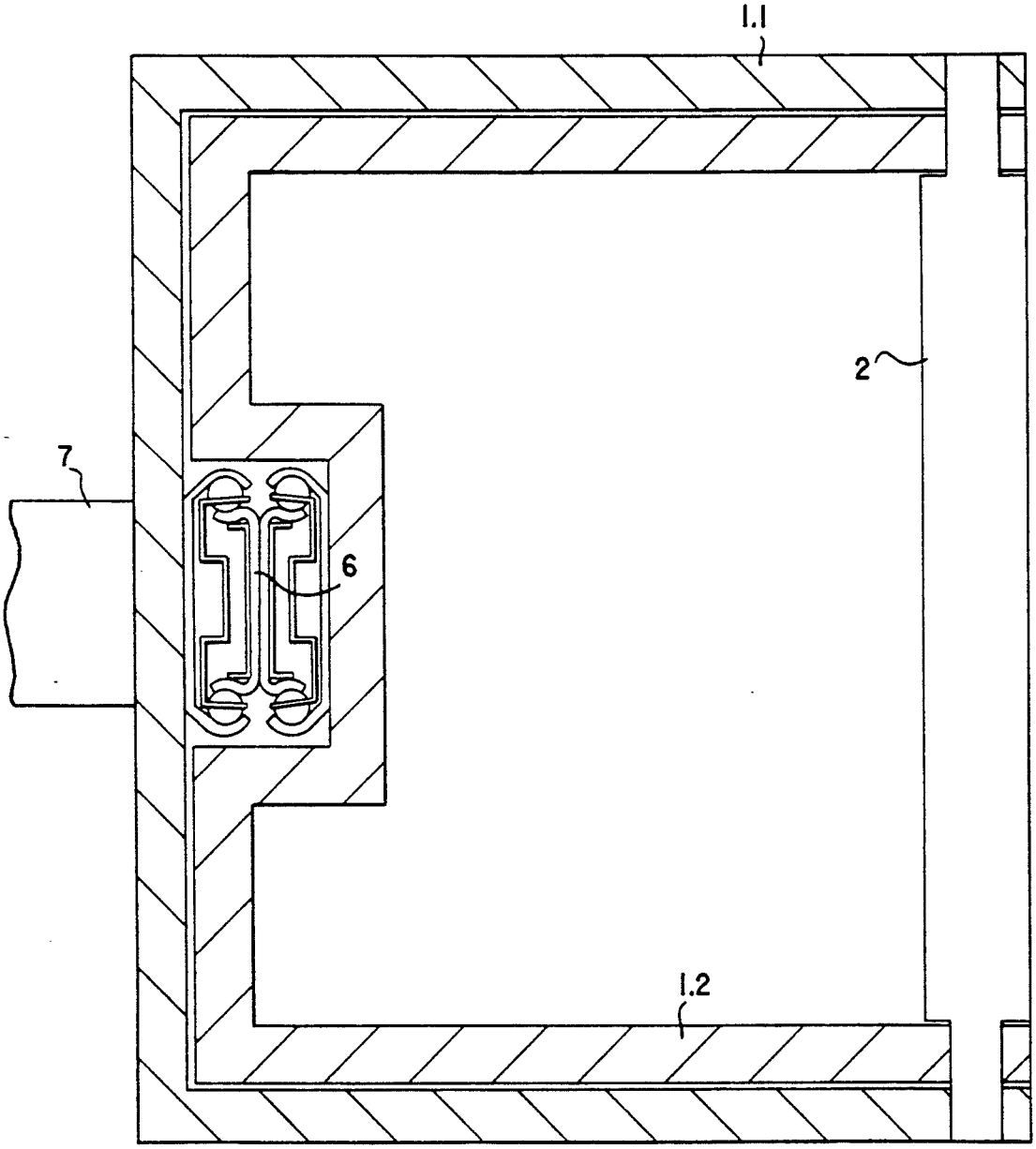
FIG. 4 is an enlarged cross-sectional view of FIG. 3 taken along the line IV—IV in the direction of the arrows.

Beginning with the view shown in FIG. 2 for a maximum sheet format, the movable housing part 1.2 is slid into the fixed housing part 1.1 if there is a reduction in the sheet format. Consequently, the sections 2 adjacent to the end of the movable housing part 1.2 pass, via the direction-reversal or deflection location 4,, into the guide part 5 so as to assume a waiting i.e. storage position therein. The side stop thus adapts or adjusts in an infinitely variable manner to each format setting. The length of the fixed housing part 1.1 is a design factor which depends upon the smallest possible sheet-format setting. It is advantageous for the adjustment of the movable housing part 1.2 to be effected simultaneously with the operation of other format-adjustment elements, for example, convexing means in the form of a suction roller 9 which is positioned in front of the sheet pile 14. The suction roller 9 is attached to a guide rail 10, which is connected, via a guide roller 11 in a slot 12, to the movable housing part 1.2, so that the adjustment motion of the suction roller 9, which takes place in the sheet transport direction is transmitted to the movable housing part 1.2. The arrangement of the guide roller 11 in the slot 12 permits the performance of the aforementioned adjustment motions by the side stop transversely with respect to the sheet-transport direction.

The foregoing is a description corresponding in substance to German Application P 41.39 978.1, dated Dec. 4, 1991, the International priority of which is being claimed for the instant application, and which is hereby made part of this application. Any material discrepancies between the foregoing specification and the aforementioned corresponding German application are to be resolved in favor of the latter.

What is claimed is:

1. Device for stacking sheets in a pile in a sheet delivery of a printing press having conveying means for transporting sheets in a given direction away from said printing press onto the pile, and a lifting table whereon the sheets are lowerable, the device comprising a front stop for leading edges of the sheets disposed in a region wherein an upper end of the sheet pile is located, side stops disposed laterally of said front stop and adjustable to varying formats of the sheets, each of said side stops comprising a multiplicity of sections successively arranged in the given direction and being movable relative to one another, wherein sections exceeding a successive arrangement of said sections which matches the format length of the sheets in the sheet pile are displaceable into a storage position, and respective guides for said sections of said side stops, each of said guides being formed of two parts.

2. Device according to claim 1, wherein the sections of each side stop form a continuous band extending in the given sheet transport direction and are held at respective ends thereof in the respective guide, said guide being formed with a direction-directing location in one of said telescoping parts.

3. Device according to claim 1, including a housing wherein each of said guides are formed, the housing including two housing parts, one of said parts being laterally adjustable, and including a telescopic mounting in at least the other one of said parts.

4. Device according to claim 3, wherein said sections of said side step having opposite ends, and said housing includes a lower and an upper guide track wherein said ends of said sections of said side stop engage said guide tracks, said lower and said upper guide track being formed with a parking loop in one of said parts of said housing.

5. Device according to claim 3, wherein said housing is formed with a union for connecting an air extractor thereto.

6. Device according to claim 3, wherein said sections of each of said side stops form parts of a flexible grid band.

7. Device according to claim 6, wherein said flexible grid band is formed of plastic material.

8. Device according to claim 7, including linear bearing rails with rolling bodies disposed between said housing parts.

9. Device according to claim 3, wherein one of said housing parts is displaceable and is connected to parts which are adjustable for format changes.

* * * * *